US006637138B2

(12) United States Patent
Prost

(10) Patent No.: US 6,637,138 B2
(45) Date of Patent: Oct. 28, 2003

(54) SHAPE-SHIFTING GAME CAN

(75) Inventor: Christian Prost, Tsim Sha Tsui (HK)

(73) Assignee: Intermed Asie Company Limited, Hong Kong (HK)

( * ) Notice: Subject to any disclaimer, the term of this patent is extended or adjusted under 35 U.S.C. 154(b) by 0 days.

(21) Appl. No.: 10/083,595

(22) Filed: Feb. 27, 2002

(65) Prior Publication Data

US 2003/0061747 A1 Apr. 3, 2003

(30) Foreign Application Priority Data

Sep. 30, 2001 (CN) ..... 01265698 U

(51) Int. Cl.[7] ..... A63F 9/08

(52) U.S. Cl. ..... 40/427; 40/538; 273/157 R; 273/155

(58) Field of Search ..... 40/427, 538, 539; 273/155, 157 R

(56) References Cited

U.S. PATENT DOCUMENTS 5,192,077 A * 3/1993 Caicedo ..... 273/155

6,467,205 B1 * 10/2002 Flagg et al. ..... 273/157 R

* cited by examiner

*Primary Examiner*—Cassandra H. Davis
(74) *Attorney, Agent, or Firm*—Bacon & Thomas, PLLC

(57) ABSTRACT

A shape-shifting game can. The game can includes upper and lower cylindrical blocks superimposed on each other. Each of the cylindrical blocks are quartered to form a total of eight fan-shaped columns and each of the fan-shaped columns comprise upper and lower fan-shaped surfaces, a circumferential surface and a pair of square surfaces. The lower fan-shaped surfaces of the upper cylindrical block and the upper fan-shaped surfaces of the lower cylindrical block are connected with fan-shaped stickers. Pairs of the upper fan-shaped surfaces of the upper cylindrical block and pairs of the lower fan-shaped surfaces of the lower cylindrical block are connected with hemi-cycle patterned stickers. The square surfaces of the fan-shaped columns are connected with double-block stickers. The circumferential surfaces of the cylindrical blocks are connected with four fan-shaped column stickers and two hemi-cycle column stickers respectively.

2 Claims, 6 Drawing Sheets

SHAPE-SHIFTING GAME CAN

BACKGROUND OF THE INVENTION

1. Field Of The Invention

The invention relates to patterned stickers particularly for turning a game can, to be used for many purposes, such as a brainstorming game, advertisement, and stationery.

2. Description Of The Related Art

The well-known square device can only be played by changing each square. It lacks flexibility in appearance and can only be turned in a certain way. The complicated structure limits the interest of the player, and it is difficult to turn it back to the original appearance and easily frustrates the player and reduces the entertainment effect.

Besides, the square can only be used for entertainment. It does not present a pleasant visual effect and has no added value. In this modern society filled with creativity and variety, it can no longer meet the consumers' satisfaction. Most of the time, it is put aside after being played for several times and thus cannot be kept for long. There is a need for a multifunctional magic square, which offers the entertainment, present a pleasant visual effect.

SUMMARY OF THE INVENTION

The main purpose of this invention is to offer entertainment and promote a brainstorming game and advertise patterns. It can also be used as stationery. The embodiment has eight fan-shaped columns. The stickers are cut and pasted in a special way, and this makes the invention easier to operate. By turning the eight fan-shaped columns, this invention can present a magical change of the patterns.

DETAILED DESCRIPTION OF THE PREFERRED EMBODIMENT

Figure 1:
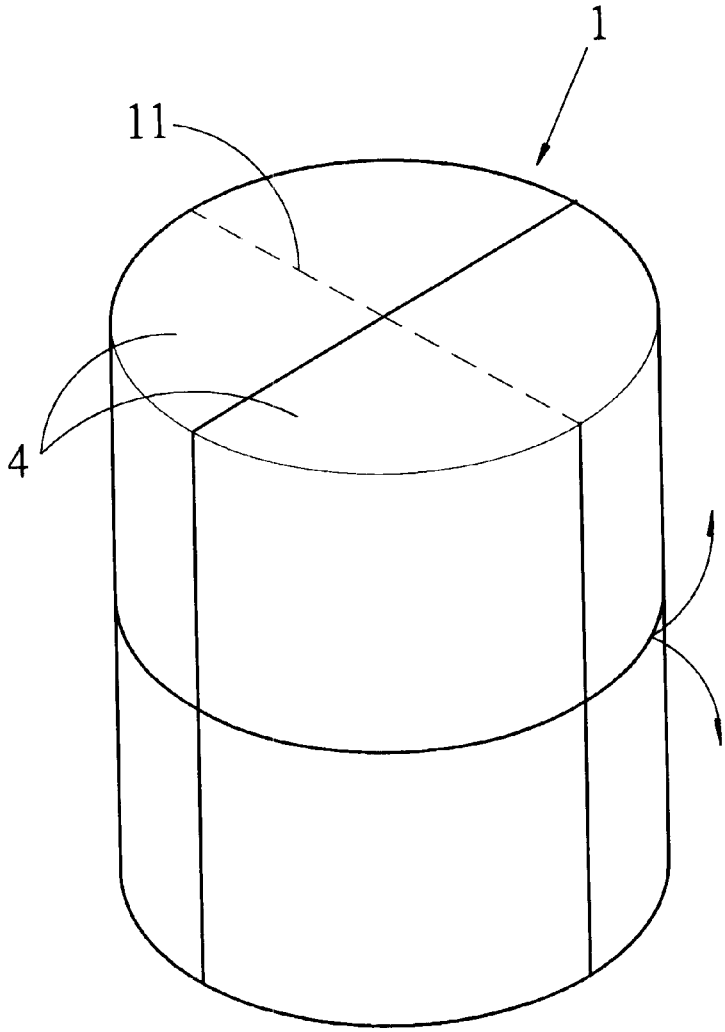
FIG. 1 is a perspective view of the inventive device.
Figure 2:
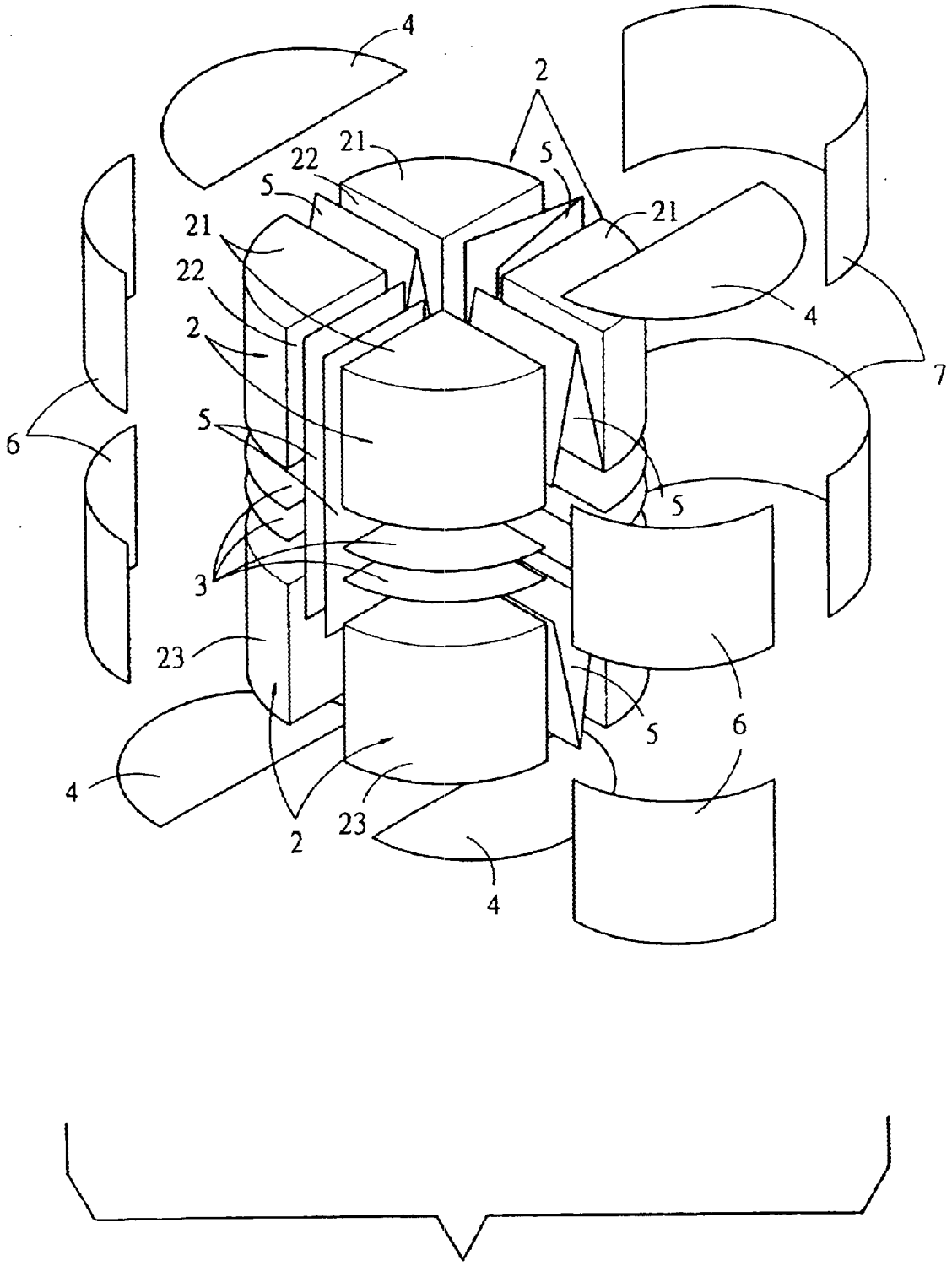
FIG. 2 is an exploded view of the inventive device.

This invention is a cylinder 1 comprised of eight fan-shaped columns (2). In FIG. 1 and FIG. 2, there are sixteen fan-shaped surfaces (21) pasted with eight fan-shaped stickers (3) and four hemi-cycle stickers (4), sixteen square surfaces (22) pasted with eight double-block stickers (5) and eight circumferential surfaces (23) pasted with four fan-shaped column stickers (6) and two hemi-cycle column stickers (7). As shown in FIG. 2, the double-block stickers (5) may be folded or unfolded.

A sticker pasted on two surfaces thereof may link the fan-shaped columns (2) together, which allows the columns to be turned, i.e. through the four hemi-cycle patterned stickers (4), eight double-block stickers (5), and two hemi-cycle column stickers (7), and each fan-shaped column (2) is linked together. Because the paper is foldable, this embodiment can be turned to present various and special appearances.

Figure 3:
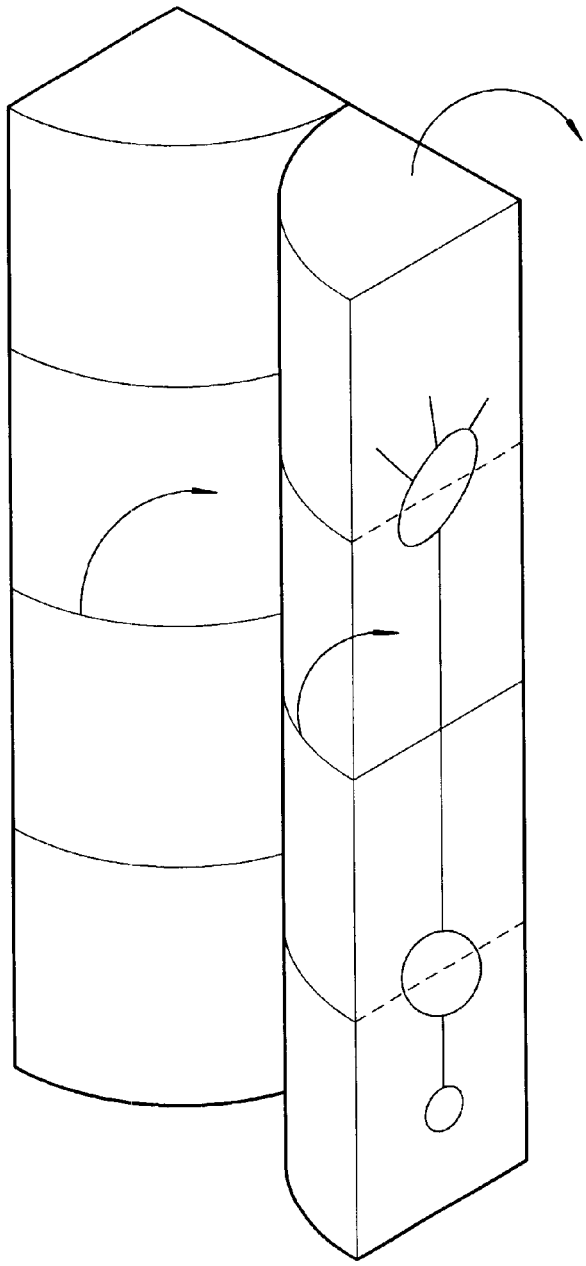
FIGS. 3–6 show various configurations of the inventive device.

From the central part of the cylinder (1), take the fold line (11) of the four hemi-cycle stickers (4) on the upper and the subjacent cycle surfaces as the axis and turn, then take the fold line (11) of the double-block sticker (5) as the axis and turn, and then the invention may present a special appearance and several oblong advertisement patterns as shown in FIG. 3.

Figure 4:
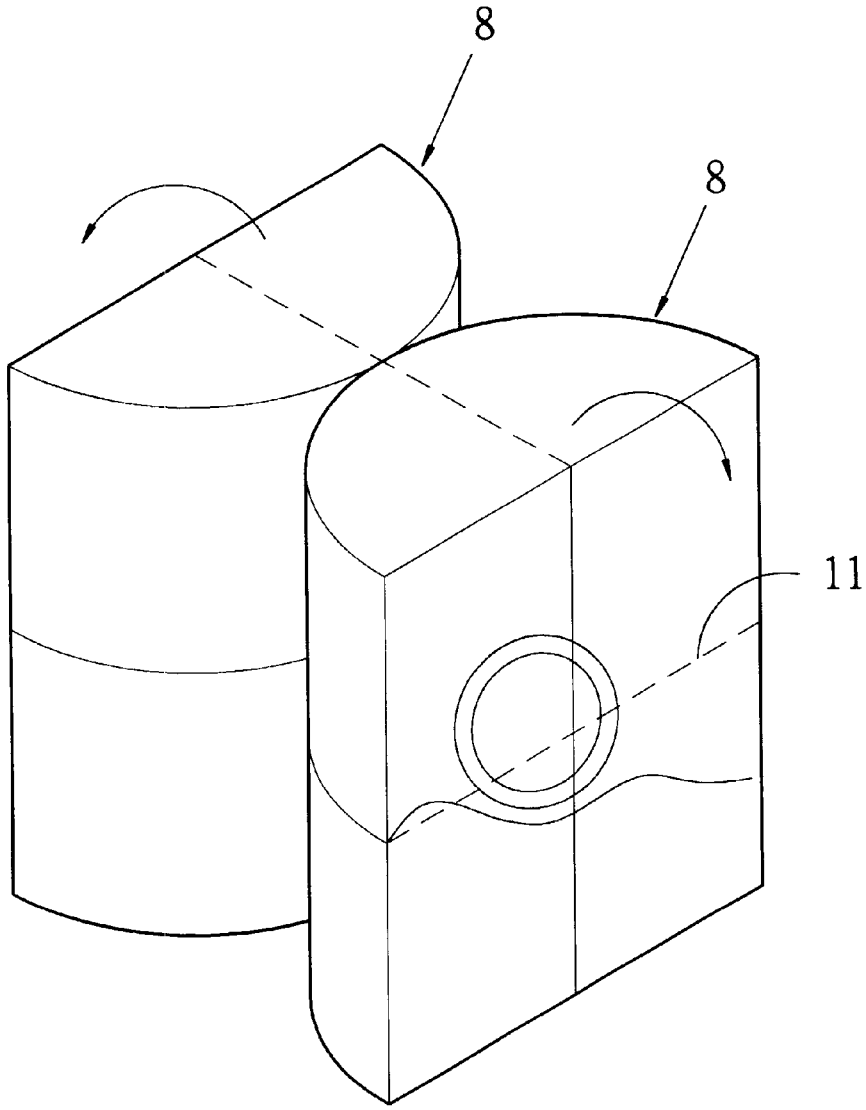

Next, follow the fold line (11) in the central part and turn, and the invention becomes two semi-cycle columns (8) with backs against to each other as shown in FIG. 4. By doing this, the invention presents another two oblong advertisement patterns.

Figure 5:
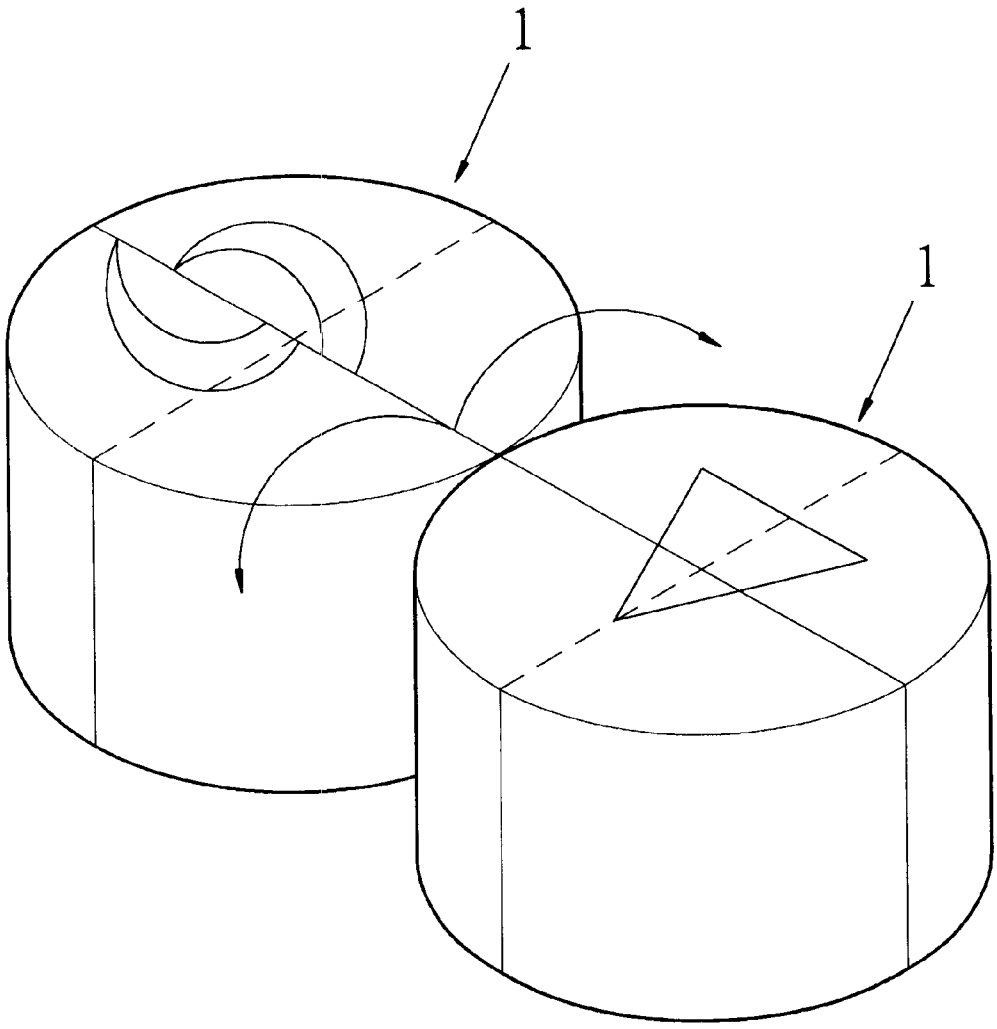

Take the fold line (11) as the axis and turn downwards, and then this cylinder (1) becomes two cylinders (1) and presents another two complete circle advertisement patterns as shown in FIG. 5. If the fold line is followed and turned outwards, another special appearance may be presented. The inventive device can then be easily turned back to the original cylinder (1).

Figure 6:
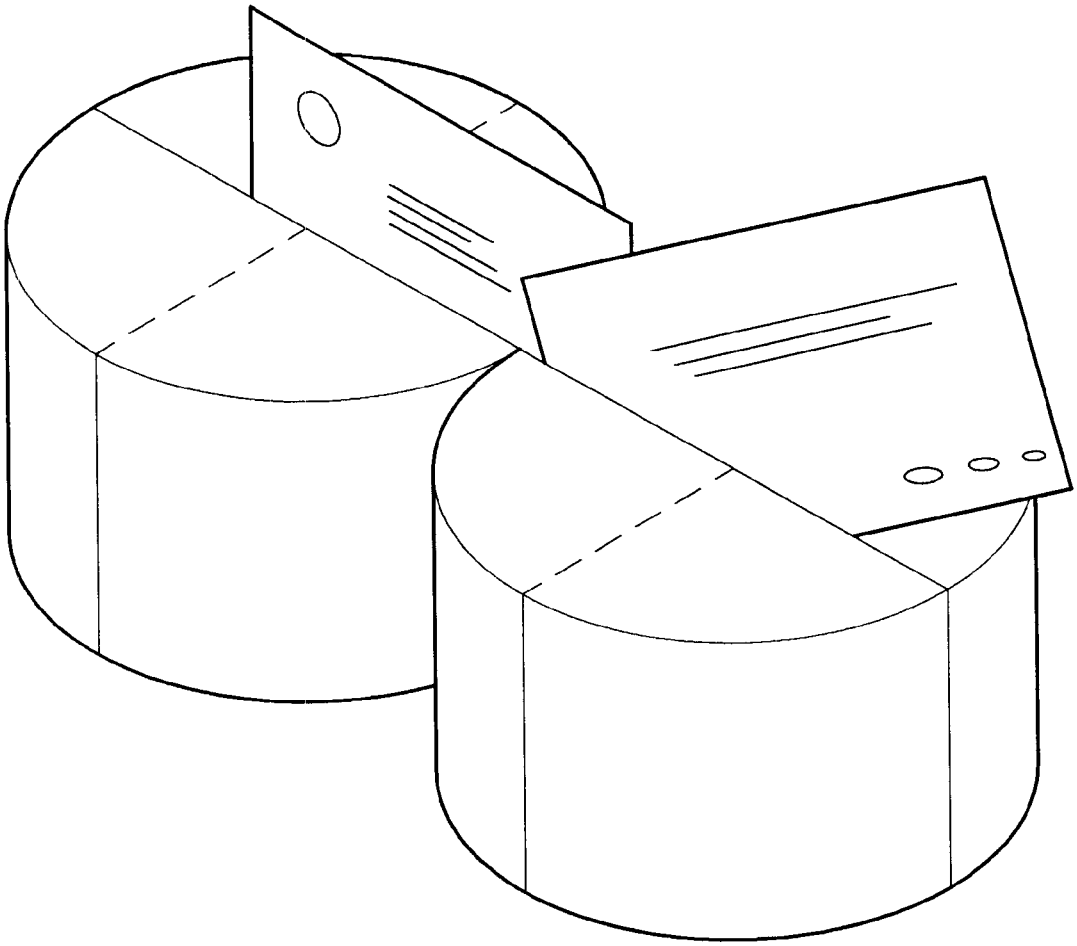

FIG. 6 is another example of this invention used as a card clip or note clip. The inventive e device stimulates creativity and fun and its multifunction also increases its practical appeal.

The invention device may stimulate fun and variety, and can be changed in shape into other appearances. The stickers on each surface can also stimulate visual senses. Besides, this invention can also be used as a card clip or other stationery. The inventive device has multiple functions.

What is claimed is:

1. A shape-shifting game can comprising:

upper and lower cylindrical blocks superimposed on each other, each of the cylindrical blocks are quartered to form a total of eight fan-shaped columns, each of the fan-shaped columns comprise upper and lower fan-shaped surfaces, a circumferential surface and a pair of square surfaces;

the lower fan-shaped surfaces of the upper cylindrical block and the upper fan-shaped surfaces of the lower cylindrical block are connected with fan-shaped stickers;

pairs of the upper fan-shaped surfaces of the upper cylindrical block and pairs of the lower fan-shaped surfaces of the lower cylindrical block are connected with hemi-cycle patterned stickers;

the square surfaces of the fan-shaped columns are connected with double-block stickers;

the circumferential surfaces of the cylindrical blocks are connected with four fan-shaped column stickers and two hemi-cycle column stickers, respectively; and the fan-shaped columns are configured to be detachable and reconfigurable.

2. The shape-shifting game can of claim 1, wherein the game can is configured as a card clip such that a pair of cards are inserted on the square surfaces of the fan-shaped columns of the upper and lower cylindrical blocks.

* * * * *